US006077043A

United States Patent [19]

Hill et al.

[11] Patent Number: 6,077,043

[45] **Date of Patent: *Jun. 20, 2000**

[54] IMPELLER FOR A FAN AND A METHOD FOR MAKING SAME

[75] Inventors: D. Lee Hill, Olathe, Kans.; Jimmy D. Vanfossan, Gladstone, Mo.; Hamid Massali, Leawood, Kans.

[73] Assignee: Emerson Electric Co., St. Louis, Mo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/769,794

[22] Filed: Dec. 19, 1996

[51] Int. Cl.[7] ..... F04D 29/38

[52] U.S. Cl. ..... 416/202; 416/210

[58] Field of Search ..... 416/202, 210, 416/145

[56] References Cited

U.S. PATENT DOCUMENTS

| | | | |
|---|---|---|---|
| D. 141,235 | 5/1945 | Birsh | 416/145 |
| 550,107 | 11/1895 | Longauer . | |
| 1,194,413 | 8/1916 | Nesseler . | |
| 1,423,717 | 7/1922 | Hicks . | |
| 1,432,710 | 10/1922 | Macmechen . | |
| 1,793,814 | 2/1931 | McCaig . | |
| 1,799,745 | 4/1931 | Gunn | 416/145 |
| 1,879,935 | 9/1932 | Hill | 416/202 |
| 2,017,431 | 10/1935 | Anderson et al. . | |
| 2,054,383 | 9/1936 | Ludewig . | |
| 2,207,948 | 7/1940 | Sheridan . | |
| 2,215,035 | 9/1940 | Gunelfinger . | |
| 2,233,747 | 3/1941 | Riedl | 416/202 |
| 2,259,853 | 10/1941 | Koch . | |
| 2,345,516 | 3/1944 | Weber . | |
| 2,658,666 | 11/1953 | Krzesiewski . | |
| 2,728,519 | 12/1955 | McLarty . | |
| 2,862,657 | 12/1958 | Copeland et al. . | |
| 3,306,179 | 2/1967 | Lambie et al. | 416/202 |
| 4,242,046 | 12/1980 | Matucheki et al. . | |
| 4,285,637 | 8/1981 | Thompson . | |
| 4,319,866 | 3/1982 | Kolthoff . | |
| 4,439,108 | 3/1984 | Will . | |
| 4,863,351 | 9/1989 | Fischer et al. . | |
| 5,246,343 | 9/1993 | Windsor et al. . | |
| 5,462,411 | 10/1995 | Bianchi . | |

FOREIGN PATENT DOCUMENTS

| | | | |
|---|---|---|---|
| 25882 | 11/1903 | United Kingdom | 416/202 |

*Primary Examiner*—John Kwon
*Attorney, Agent, or Firm*—Stook, Hardy & Bacon L.L.P.

[57] ABSTRACT

An impeller for a fan, with improved performance characteristics, has a central hub with a plurality of wings extending radially outwardly therefrom. The impeller also has a plurality of blades, such that each blade is attached in an extending manner from a corresponding one of the wings. When in combination with a fan having a motor, the motor imparts rotation to the impeller in a forward direction. Each blade is angled backwardly, at a selected angle, relative to its corresponding wing and the forward, rotational direction of the impeller. In an alternate embodiment, each wing of the hub has a first portion extending radially outward from the hub and a second, outer portion angled backwardly relative to the first portion of the wing and the forward direction of the impeller. A method of manufacture is provided.

4 Claims, 5 Drawing Sheets

IMPELLER FOR A FAN AND A METHOD FOR MAKING SAME

BACKGROUND OF THE INVENTION

1. Field of the Invention

The present invention is generally directed to an electric fan and, more particularly, to a rotor or impeller assembly for an electric fan. More specifically, the present invention is directed to a unique arrangement and technique for securing one or more fan blades to a hub utilized on an electric fan.

2. Description of the Related Art

Impellers having a number of metallic fan blades attached to a hub, also commonly referred to as rotor assemblies or propellers, are widely used in a variety of domestic, commercial, and industrial fan equipment. For instance, impellers are typically used in HVAC equipment, ventilation equipment, and a wide variety of air circulation fans. In many commercial or industrial environments, such as in an automobile plant, impellers are found in great quantity in air circulation fans located above numerous, individual work stations.

Impellers designed for use in industrial and commercial environments must be capable of withstanding long durations of use, and therefore must be highly durable. Additionally, the efficiency of an impeller is highly important, particularly when used in an industrial environment where hundreds or possibly thousands of units may be installed. A typical measure of impeller performance is the amount of air output by the impeller, conventionally measured in cubic feet per minute (CFM), but important factors such as overall power consumption and the heat rise of the device employing the impeller (e.g., a fan) are also monitored when evaluating impeller, or fan, performance. As used herein, the term "fan" means any device or equipment utilizing an impeller, including, although not necessarily limited to, an electric fan, an air circulator, HVAC equipment and ventilation equipment.

In view of the importance of impeller performance, manufacturers of fans or impeller components are constantly attempting to improve their performance. The conventional approach to improving the performance of a fan or impeller used on a fan has been to alter the shape of the fan blade used on the impeller. In this regard, many past attempts have been made to improve fan performance by modifying the shape of the fan blade, often resulting in complex parabolic or hyperbolic blade configurations.

A primary problem with the prior art approach of modifying the shape of the fan blade to achieve better fan performance is the expense associated with the design, testing, and tooling required to arrive at the desired blade configuration. Additionally, in many circumstances, it is difficult or impractical to use preferred durable materials, such as metal, to achieve the configuration desired.

Efforts to improve fan performance have also included varying the pitch at which the blades of a fan attack the surrounding air. Increasing the pitch of the blade increases drag, and hence increases air flow. However, increasing the pitch of the blades increases the strain on the motor, and there are thus practical limits to which the pitch can be increased.

Accordingly, the need exists for a fan having improved performance, and namely an electric fan with increased air flow characteristics, decreased power requirements, and which causes less heat rise in the motor associated with the fan. Additionally, the need exists for an electric fan, and particularly an impeller for an electric fan, which is simple and inexpensive to manufacture, and does not require redesigning the blade or developing expensive tooling for a new blade configuration. In this regard, their is a need for an improved fan which uses existing impeller components, such as a conventional hub and blades.

In short, the need exits for a cost effective solution to increasing fan performance without the significant investment required for reconfiguring and tooling a new fan blade. The present invention fulfills these and other needs, and overcomes the drawbacks of the prior art.

SUMMARY OF THE INVENTION

An impeller for a fan has a central hub with a plurality of wings extending radially outward from the central hub. The impeller includes a plurality of fan blades, such that each wing of the hub has a fan blade connected thereto and extending outwardly therefrom. The hub of the impeller of the present invention is designed for connection to the rotary output of a motor, in a conventional manner. In combination with a fan, including the motor, the impeller is rotated by the motor in a forward, rotational direction.

In accordance with an aspect of the present invention, each fan blade is angled backwardly, generally within the plane of rotation, relative to the wing with which it is connected and also relative to the forward rotational direction of the impeller. Specifically, unlike prior art fan devices in which each blade of the fan and its corresponding wing are axially aligned, each blade of the present invention is angled backwardly at a selected angle relative to its associated wing and the forward direction of rotation, wherein the selected angle is preferably between zero and 15° when measured from a longitudinal axis extending through the wing.

Angling each blade backwardly in accordance with the principles of the invention reduces the drag on the blades, therefore permitting increased revolutions of the impeller in a given period of time. Due to the decreased drag on the impeller, the pitch of each blade can be increased, resulting in additional drag and, thus, enhanced air flow. The results achieved with a fan of the present invention having backwardly angled blades positioned at an increased pitch, when compared with the performance of a prior art fan using the same components, include reducing the drag and power requirements of the fan, reducing heat rise of the fan motor, increasing fan blade stability resulting in a quieter and longer lasting fan, and increasing swirl velocity around the hub or motor region of the fan resulting in an increased flow of air.

While it will be understood that the present invention is useful with a wide variety of fan blades, the unique technique for fastening each fan blade in a backwardly angled orientation relative to its respective wing is especially desirable for use with conventional metal blades, which are typically substantially rectangular in configuration. Such blades are well known, and are especially desired for their durability and the ease with which they are manufactured.

BRIEF DESCRIPTION OF THE DRAWINGS

The features of the invention noted above are explained in more detail with reference to the drawings, in which like reference numerals denote like elements, and in which.

DETAILED DESCRIPTION OF THE INVENTION

Figure 1:
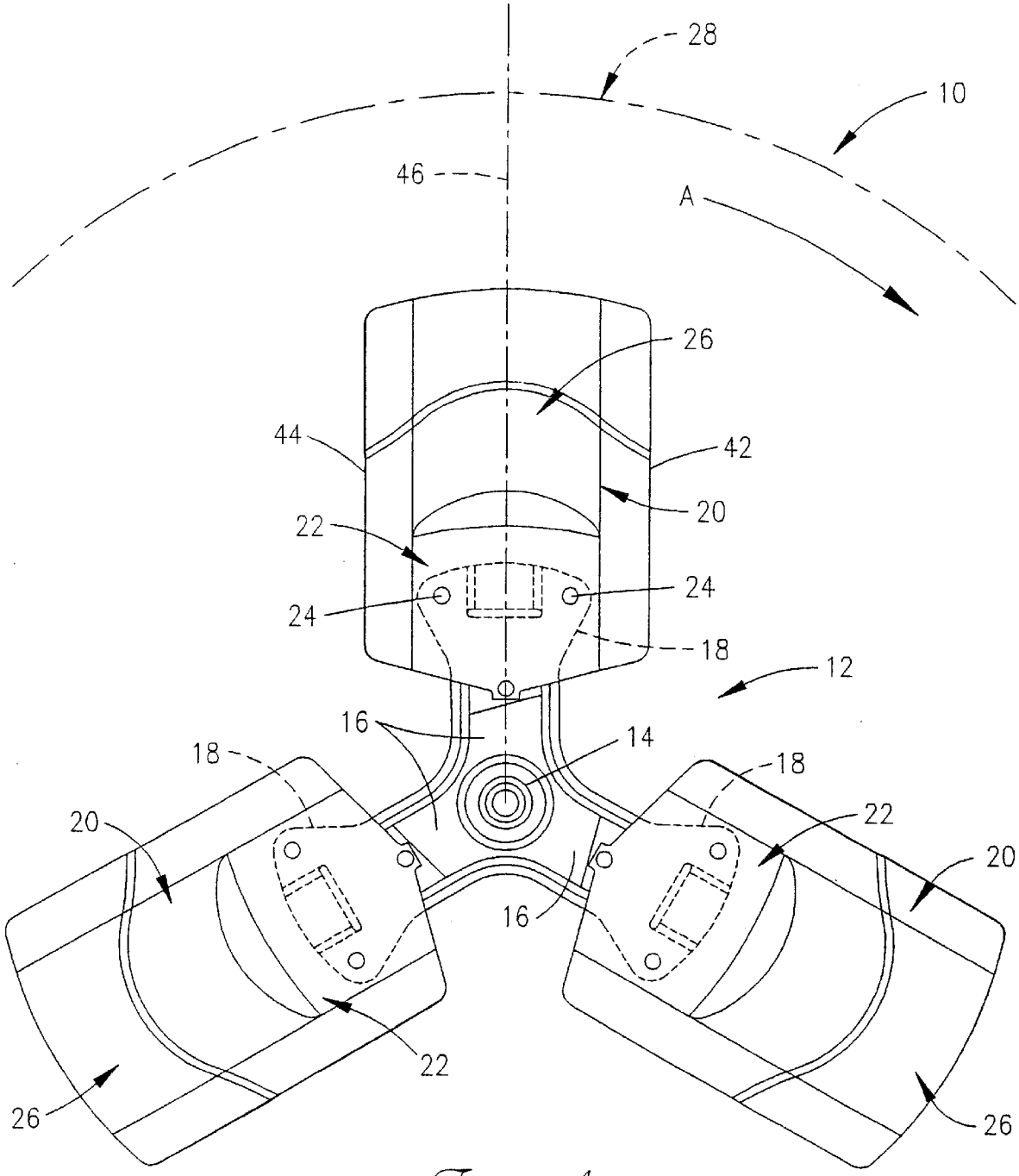
Fig. 1. (PRIOR ART)
FIG. 1 is a front elevational view of a prior art impeller, with a fan cage shown schematically.
Figure 2:
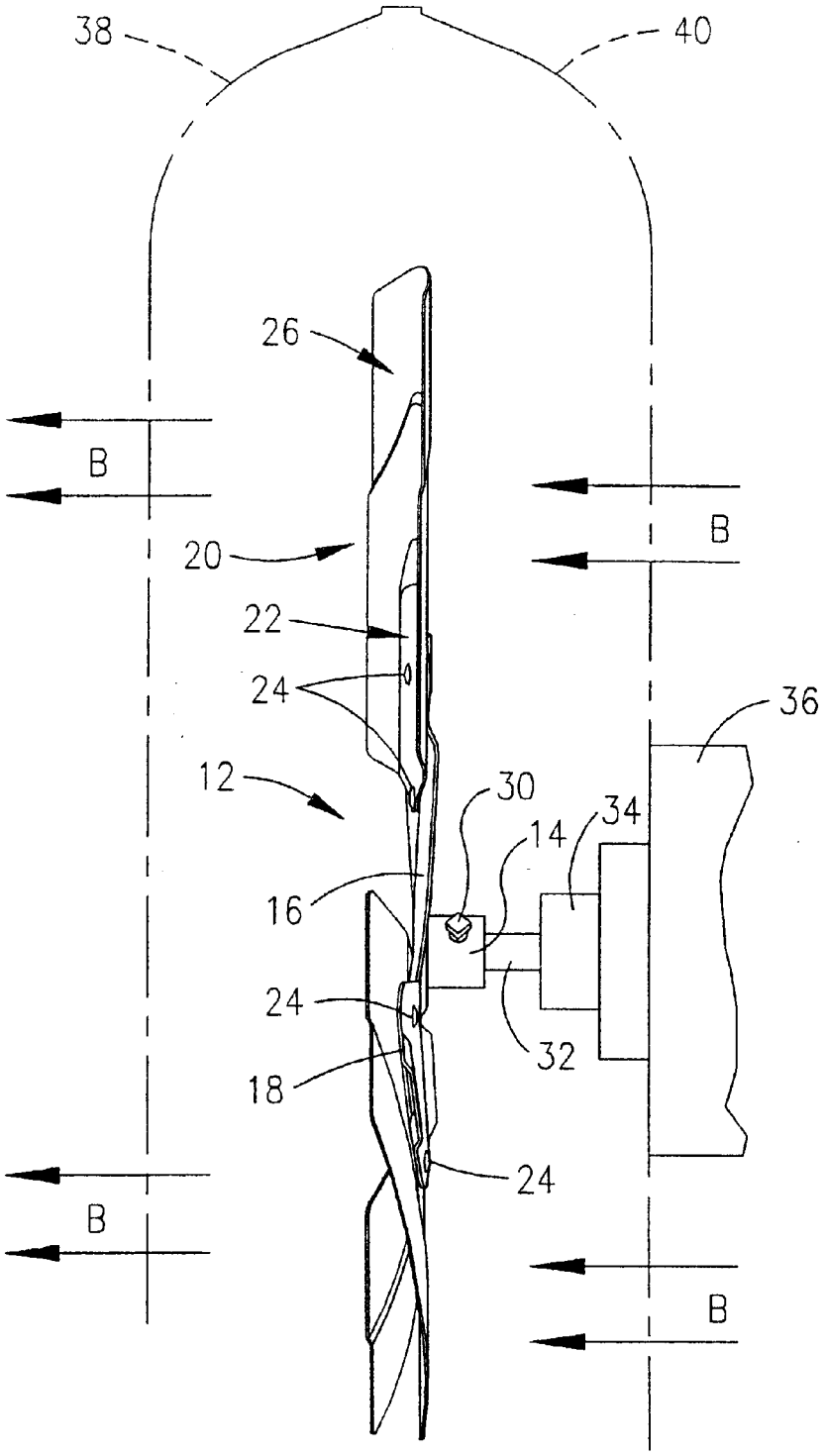
Fig. 2. (PRIOR ART)
FIG. 2 is a left end view of the prior art impeller, illustrated in FIG. 1, further illustrating portions of a conventional motor as embodied in a conventional fan, including a fan guard represented schematically.

With reference initially to FIGS. 1 and 2, a prior art fan is designated generally by the reference numeral 10. As illustrated, prior art fan 10 incorporates a conventional, prior art impeller 12 having a central hub 14. Central hub 14 has a plurality of wings 16 extending radially outwardly from central hub 14. Each wing 16 has an enlarged head region 18 at its outer end. Prior art impeller 12 also includes a plurality of fan blades 20. Each fan blade has an inner portion, designated generally by reference numeral 22, which is secured to a corresponding wing 16, and particularly, is secured by fasteners 24 to the paddle region 18 of its corresponding wing 16. Each blade 20 also has an outer portion, designated generally by reference numeral 26, extending outwardly from its associated wing 16 in the manner shown.

As illustrated in FIG. 2, central hub 14 of impeller 12 is connected by a fastener, such as bolt 30, to the rotary shaft 32 of a conventional electric motor 34, having a motor housing 36. As illustrated, fan guard 28 is formed of any conventional front fan guard member 38 and rear fan guard member 40.

The components and assembly of prior art fan 10 illustrated in FIGS. 1 and 2 will be generally understood and appreciated by those with skill in the art. Central hub 14 of impeller 12 is preferably formed of metal. As illustrated in FIG. 2, each wing 16 extending from central hub 14 is preferably pitched in a conventional manner. The degree of pitch in the prior art device is a matter of design choice, and is based upon the size of the blades 20 as well as the speed of the motor 34. For example, one conventionally used pitch for a fan having twenty-four inch blades and a motor in the 1,700 RPM class is approximately 7°, as illustrated. As will be understood, pitching the blades greater than approximately 7° for such a fan causes excessive drag, and hence excessive strain on the motor. The prior art fan blades 20 illustrated in FIGS. 1 and 2 are preferably formed of metal, and are at least generally rectangular in configuration, as illustrated. Arrow A in FIG. 1 illustrates a forward direction of rotation when impeller 12 is rotated in a conventional manner by electric motor 34. In this manner, each blade 20 defines a leading edge 42 and a trailing edge 44 which are parallel to each other.

In accordance with the established principles of fan and impeller construction, each blade 20 extends radially outwardly from hub 14. Particularly, each blade 20 is axially aligned along a longitudinal axis, represented by reference numeral 46, with its corresponding wing 16, in the manner illustrated. During operation of the fan, electric motor 34 imparts rotation to shaft 32, thereby imparting rotational direction to impeller 12 in a forward rotational direction represented by arrow A, and generating a flow of air in the direction very generally represented by arrows B in FIG. 2.

During operation, impeller 12 experiences the effects of drag and consumes electrical power (typically measured in the draw of electrical current, in amperes). Additionally, operation of fan 10, and particularly electrical motor 34, causes the temperature at motor 34 to rise. By measuring one or more factors such as the quantity of air flow generated by fan 10, the amount of power consumed by fan 10, and the overall rise in heat at the motor 34 during operation of fan 10, the overall performance of fan 10 can be evaluated.

Figure 3:
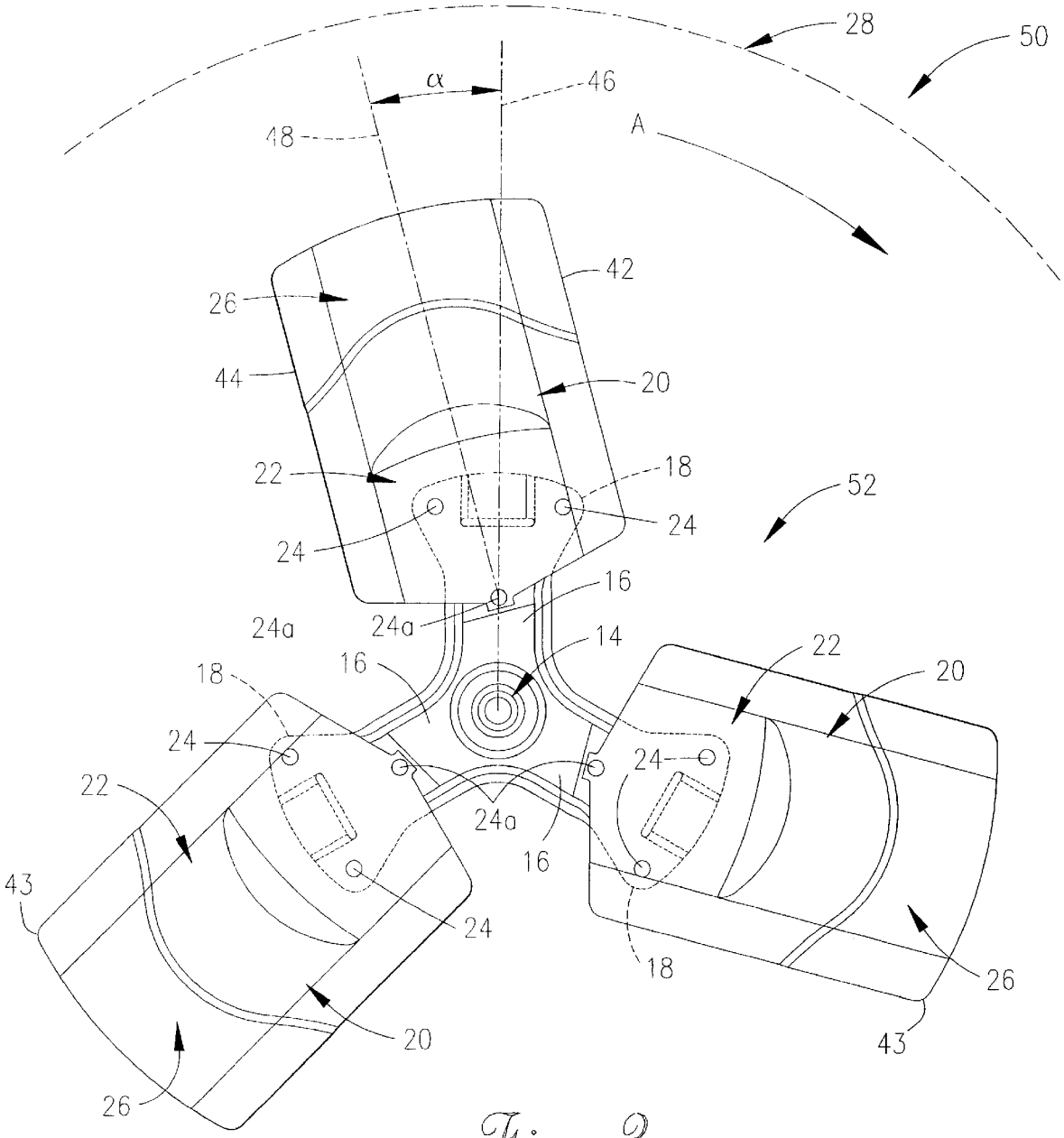
FIG. 3 is an elevational view of an impeller of the present invention with a fan guard represented schematically.
Figure 4:
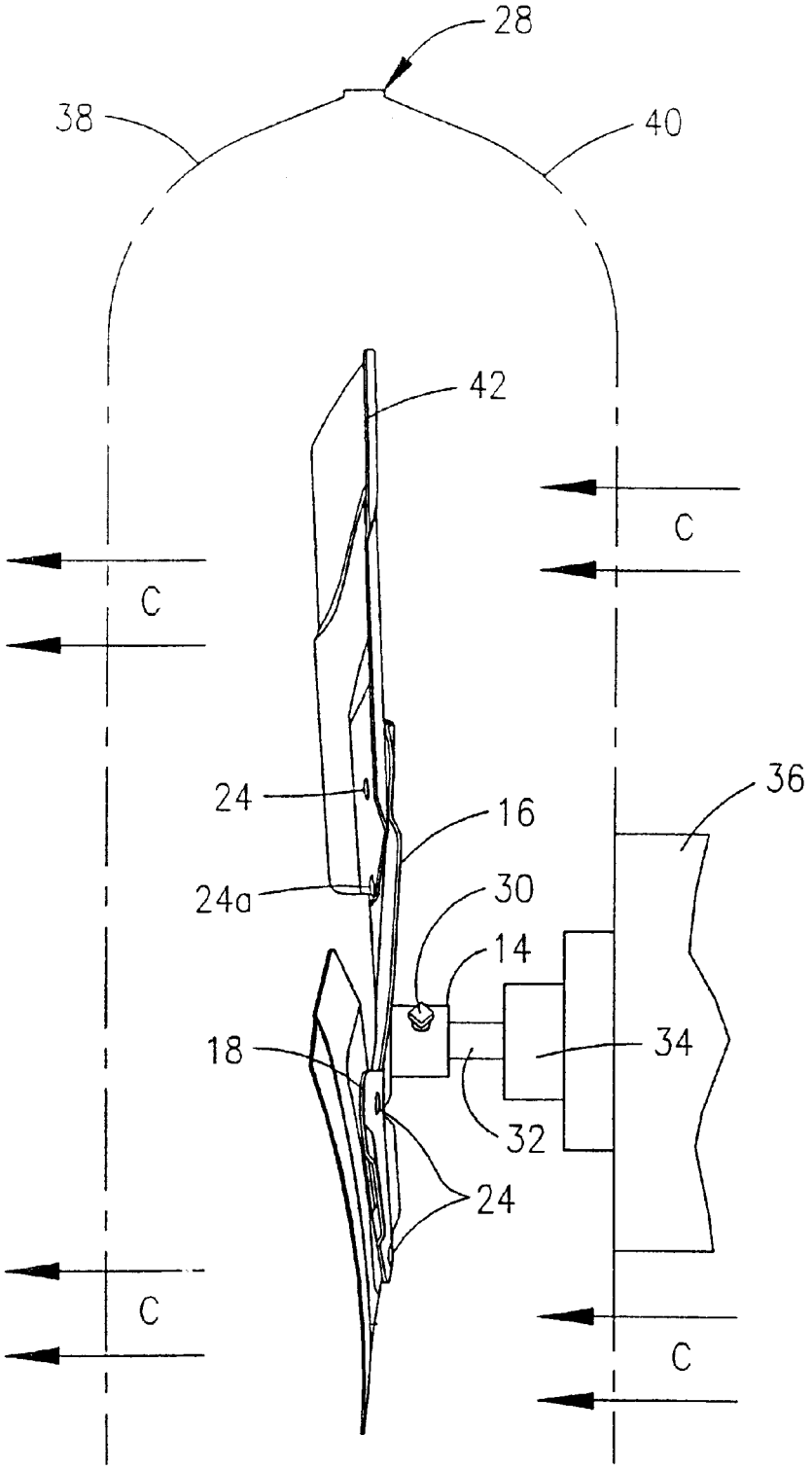
FIG. 4 is a left end view of a fan incorporating the impeller of the present invention.

It has been found that the performance of the prior art fan 10 is improved when assembled in accordance with the principles of the present invention. With reference now to FIGS. 3 and 4, a first preferred embodiment of the present invention is shown and described.

Many of the reference numerals utilized for identifying components of the present invention illustrated in FIGS. 3 and 4 have been carried over from the prior art illustration of FIGS. 1 and 2, to illustrate that components of the embodiment of the present invention illustrated in FIGS. 3 and 4 are conventional prior art components, although arranged and assembled in a different manner.

With reference to FIGS. 3 and 4, a fan 50 of the present invention has an impeller 52. Impeller 52 has a central hub 14 having a plurality of wings extending radially outwardly from central hub 14. Each wing preferably has an enlarged head region 18 at its outer end. In this regard, it will be recognized the central hub 14 with wings 16 is almost identical to that illustrated in the prior art configuration illustrated in FIGS. 1 and 2 although the pitch of wings 16 is increased, as illustrated.

Each wing 16 has a conventional blade 20 connected to its head region 18 by fasteners 24, such as rivets, as illustrated. Other fasteners, such as bolts or weld elements, could be utilized. Particularly, each blade 20 has an inner portion 22 connected to head 18 of a corresponding wing 16, and an outer portion 26 extending outwardly from its corresponding wing 16. Central hub 14 of impeller 52 is connected by a fastener, such as bolt 30, to the rotary shaft 32 of an electric motor 34, as illustrated in FIG. 4. Motor housing 36 houses the electric motor in a conventional manner. A fan guard 28, having front and rear fan guard members 38, 40 is provided, as illustrated schematically. During operation of fan 50, electrical motor 34 imparts rotation to its rotary shaft 32, which in turn imparts rotation to impeller 52 of the present invention, thereby causing it to rotate in a forward direction indicated by arrow A in FIG. 3.

In accordance with an aspect of the present invention, each fan blade 20 is angled backwardly relative to its corresponding wing and relative to the forward rotational direction of the impeller 52 during operation. Specifically, each wing 16 extends radially outward from central hub 14 along a longitudinal axis represented by reference numeral 46. Particularly, each blade 20 defines a longitudinal axis, represented by reference numeral 48, extending through the inner portion 22 and the outer portion 26 of fan blade 20, and in parallel alignment with a leading edge 42 and a trailing edge 44 of fan blade 20. More specifically, in contrast to the prior art configuration illustrated in FIGS. 1 and 2, each blade 20 is angled, or tilted, backwardly relative to the longitudinal axis 46 (a radial line) by a selected angle $\alpha$. Preferably, each blade 20 is angled backwardly relative to its corresponding wing 16 at a selected, common angle $\alpha$. The angle $\alpha$ is selected for optimum fan performance which can be determined through testing at incremental angles. It is believed that the optimum angle $\alpha$ is a function of blade width, such that optimum performance results when an outer leading corner 43 of each blade is angled to slightly less than its greatest radial distance from a center of the central hub. For the preferred blade configuration illustrated, the angle α is preferably an angle that is greater than zero degrees and less than or equal to approximately 16°. More specifically, the angle α is preferably approximately 13°–16°, and specifically approximately 15°. It should be understood, however, that backwardly angling the blades 20 results in less drag on the impeller, and that the actual angle used is selected for optimum results based upon the size and configuration of blades 20, and the speed or class of the motor utilized.

In operation, when impeller 52 rotates in the forward direction represented by arrow A, a flow of air, represented generally by arrows C in FIG. 4, is generated. During operation, impeller 52 experiences the effects of drag and consumes electrical power. Additionally, motor 34 experiences a rise in temperature during operation of fan 50. However, it has been found that the unique impeller arrangement of the present invention, and particularly the backwardly angled orientation of the blades 20 relative to their corresponding wings 16, and relative to the forward direction of rotation of impeller 52, reduces the drag experienced by impeller 52 when compared with the prior art configuration illustrated in FIGS. 1 and 2. Particularly, backwardly angling each blade 20 in the manner described reduces the camber height of the blade, thus reducing drag on the blade. As a result, power requirements of fan 50 are significantly less than the electrical power requirements of prior art fan 10. Additionally, the heat rise experienced by motor 34 of fan 50 is significantly less than the heat rise experienced by the motor 34 of prior art fan 10.

Additionally, due to the reduced drag resulting from employment of the present invention, the conventional pitch associated with the blade 20 can, according to the principles of the present invention, be increased. Increasing the pitch of the blades 20 adds drag, at least at the trailing edge of each blade 20, and therefore enhances air flow. In this regard, it has been found that the swirl velocity of the air around motor 34 is greatly increased with fan 50 of the present invention having backwardly angled blades at an increased pitch, when compared with prior art fan 10. This results in the flow of air generated by fan 50 of the present invention, as represented by arrows C in FIG. 4, being significantly greater than the flow of air generated by fan 10, as represented by arrows B in FIG. 2.

For example, it was found during testing that prior art fan 10, having blades 20 of twenty-four inches, pitched at 7°, and a motor in the 1,700 RPM class, output approximately 4,000 cubic feet per minute. The motor drew approximately 5.2 amps, and experienced a temperature rise of 83° fahrenheit. In accordance with the principles of the present invention, the twenty-four inch fan blades 20 were angled backwardly at an angle α of approximately 15°, and the pitch of the blades 20 was increased to 10°. As before, a 1,700 RPM class fan motor was utilized. Test results of the invention in such an embodiment revealed that the fan 50 of the present invention output over 5,800 cubic feet per minute, while the motor drew only 4.7 amps and experienced a temperature rise of only 72°. It will be understood that utilization of other blade sizes and motors may result in a different preferred angle α and pitch of the blades to achieve optimum results.

Additionally, during testing, it was found that the magnitude of effective stress on blade 20 of impeller 52 of the present invention did not change significantly when compared to the prior art fan 10. Additionally, although effective stress on each blade 20 of prior art impeller 12 tended to be concentrated about the leading fastener 24, tests performed on impeller 52 of the present invention revealed that the effective stress on blade 20 tends to be concentrated proximate the trailing fastener 24. As a result of this shift of stress location, the natural frequency of the blade in the first mode remained significantly greater than the operational speed (e.g., frequency in RPMs) of the motor 34. The result is a stiffer or more stable blade with little or no resonance and a fan 50 of the present invention being quieter than prior art fan 10.

The fan 50, including impeller 52 of the present invention, achieves the principle objectives of an improved fan and impeller, while utilizing prior art components and thus avoiding the necessity to invest in expensive design and tooling of a new impeller or blade configuration.

A preferred method of manufacturing fan 50, and particularly impeller 52, of the present invention is now described.

With reference initially to FIGS. 1 and 2, a method of manufacturing prior art fan 10, and particularly prior art impeller 12, is briefly described. Central hub 14, including outwardly extending wings 16, are formed of metal in any conventional manner. Metallic blades 20 are stamped from sheet stock and bent into the preferred shape, also in any conventional manner. Each blade 20 is then located, whether simultaneously or successively, in its respective illustrated location on a corresponding wing 16, and rivets 24 are installed for securing each fan blade 20 to its corresponding wing 16. As will be understood and appreciated, during assembly, each fan blade 20 is oriented relative to its respective wing 16 so that fan blade 20 extends radially outward from central hub 14 and, particularly, so that each fan blade 20 is axially aligned along a longitudinal axis 46 with its corresponding wing 16.

The preferred method of manufacturing novel fan 50, and particularly impeller 52, of the present invention is substantially like that described in connection with prior art fan and impeller 10, 12 with a few notable and important exceptions. Specifically, central hub 14, including wings 16, and each fan blade 20 is constructed in accordance with prior art principles. Due to reduced drag resulting from the angled blades, the pitch of the wings 16 may be increased over the pitch of the prior art impeller using similar components. During assembly of impeller 52, however, each fan blade 20 is securely attached in its respective location on its corresponding wing 16 so that it angles backwardly relative to its corresponding wing 16 and the forward direction of rotation of impeller 52, when operated.

In a first specifically preferred method of manufacture of impeller 52, a fan blade 20 is located into engagement with its corresponding wing 16 in axial alignment therewith, and a first fastener **24*a* is installed for initially securing blade 20 to its corresponding wing 16. Fan blade 20 is then pivoted rearwardly about fastener 24*a* to a selected location corresponding to the desired angular displacement between wing 16 and blade 20. Once positioned as desired, additional fastener 24 are installed to securely attach fan blade 20 to its corresponding wing 16. This process is carried out for each blade 20 of impeller 52**, whether successively or simultaneously.

In an alternative embodiment of the manufacturing method of the present invention, each blade 20 is initially positioned into engagement with its corresponding wing 16 at a selected angular displacement relative to wing 16, and a plurality of fasteners 24 are installed to securely attach blade 20 to its corresponding wing 16.

Figure 5:
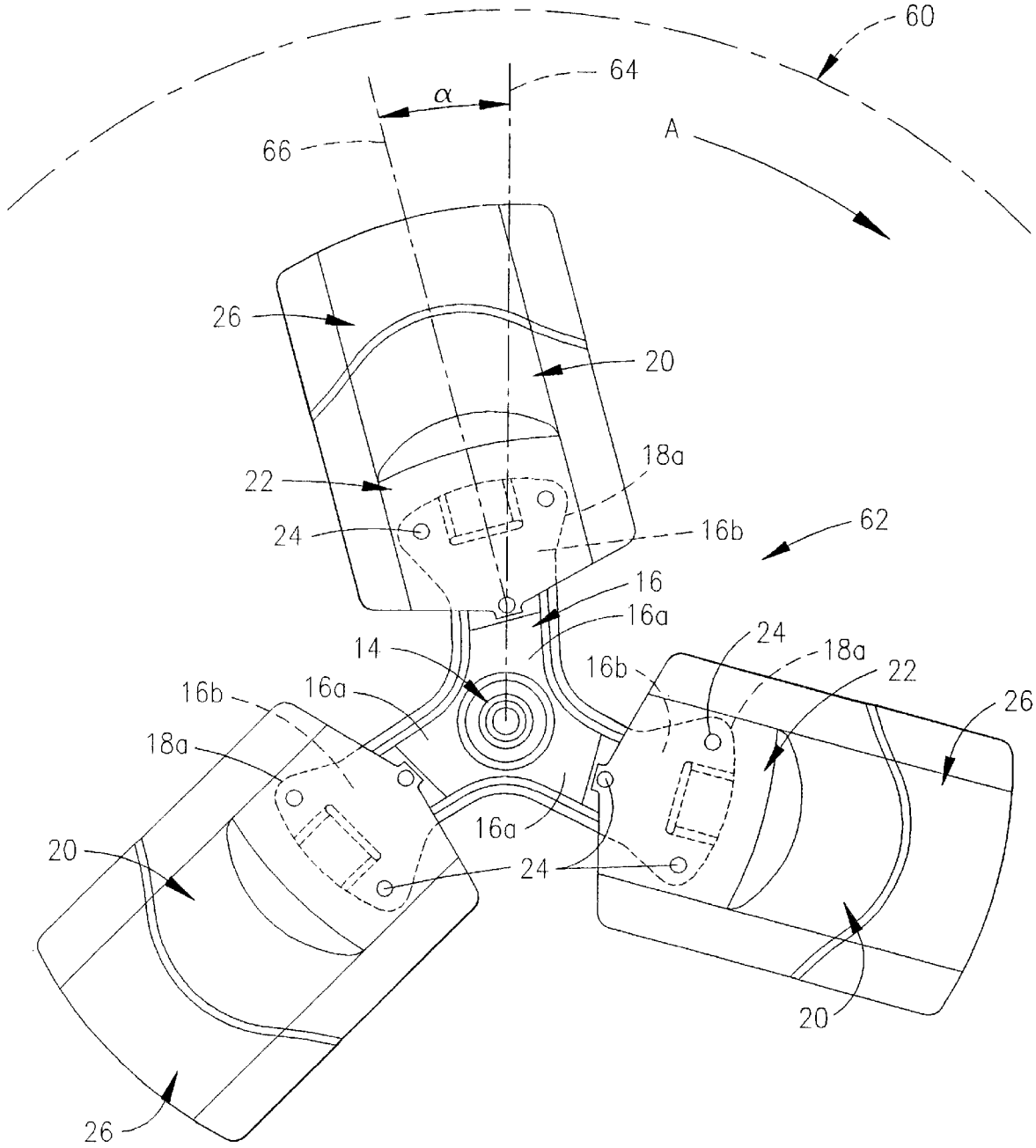
FIG. 5 is a front elevational view of an alternate embodiment of the impeller of the present invention, illustrated schematically as part of a fan of the present invention.

With reference now to FIG. 5, an alternate embodiment of a fan and impeller of the present invention, designated by reference numerals 60 and 62, respectively, are shown and described.

Fan 60 and impeller 62 illustrated in FIG. 5 achieve the same objectives as fan 50 and impeller 52 previously described. However, impeller 62 is modified to have wings 16, including a first portion 16*a* extending radially from central hub 14, and a second portion 16*b* angled rearwardly relative to first portion 16*a* of wing 16 and relative to the forward direction of rotation, represented by arrow A. Preferably, enlarged head region 18*a* comprises most or all of angled, second portion 16*b* of wing 16. At least second portion 16*b* of wing 16 is pitched to a desired pitch. In the embodiment of FIG. 5, each fan blade 20 is secured by fasteners 24 so as to be angularly displaced in a rearward fashion from a longitudinal axis 64 extending radially outwardly from central hub 14 and through first portion 16*a* of wing 16. This is accomplished by aligning each fan blade 20 along a longitudinal axis 66 which passes through second portion 16*b* of wing 16, and inner and outer portions 22, 26 of fan blade 20.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. an impeller for a fan, said impeller having a hub, with a wing defining a linear longitudinal axis, said wing extending radially outward from said hub, and a fan blade having a lower portion connected to said wing and an upper portion extending outwardly from said wing, said impeller for rotation in a forward direction to generate a flow of air, the improvement comprising:

said fan blade having a generally linear longitudinal axis and being angled backwardly relative to said linear longitudinal axis of said radially extending wing and said forward direction of impeller rotation so that said axis of said blade forms an acute angle relative to said radially extending wing, thereby reducing drag on the impeller when it rotates in said forward direction.

2. The impeller as set forth in claim 1, wherein said impeller has a plurality of spaced-apart wings extending radially outward from said hub and a plurality of fan blades, each said wing having a fan blade attached thereto and extending outwardly therefrom, the improvement further comprising:

each said fan blade being angled backwardly relative to said wing and said forward direction of impeller rotation, thereby reducing drag on the impeller when it rotates in said forward direction.

3. In the impeller of claim 1, said wing being pitched a first pitch, wherein the improvement further comprises:

said wing being pitched at a selected, second pitch that is greater than said first pitch.

4. In a fan having a motor, said motor having a rotary output adapted to rotate in a forward direction, a hub fixedly connected to said rotary output of said motor, a wing extending entirely radially outward from said hub, and a fan blade having a lower portion connected to said wing, and an upper portion extending outwardly from said wing, and at least one fan guard, said impeller for rotation in a forward direction to generate a flow of air in the direction opposite said motor, the improvement comprising:

said fan blade having a generally linear longitudinal axis and being angled backwardly relative to said entirely radially extending wing and said forward direction of impeller rotation, so that said axis of said blade forms an acute angle relative to said radially extending wing, thereby reducing drag on the impeller when it rotates in said forward direction.

* * * * *